US009578995B2

(12) United States Patent
Hanley

(10) Patent No.: US 9,578,995 B2
(45) Date of Patent: Feb. 28, 2017

(54) MULTI-PIECE TWO-HOOK HANGER FOR A SHOWER CURTAIN

(71) Applicant: Kenney Manufacturing Company, Warwick, RI (US)

(72) Inventor: Michael Hanley, Smithfield, RI (US)

(73) Assignee: KENNEY MANUFACTURING CO., Warwick, RI (US)

( * ) Notice: Subject to any disclaimer, the term of this patent is extended or adjusted under 35 U.S.C. 154(b) by 0 days.

(21) Appl. No.: 14/870,980

(22) Filed: Sep. 30, 2015

(65) Prior Publication Data

US 2016/0088977 A1 Mar. 31, 2016

Related U.S. Application Data

(60) Provisional application No. 62/057,895, filed on Sep. 30, 2014.

(51) Int. Cl.

| | |
|---|---|
| ***A47H 13/00*** | (2006.01) |
| ***A47K 3/38*** | (2006.01) |
| ***A47H 13/04*** | (2006.01) |

(52) U.S. Cl.

CPC ..... *A47K 3/38* (2013.01); *A47H 13/04* (2013.01)

(58) Field of Classification Search

CPC ..... A47K 3/38; A47H 13/00; A47H 13/02; A47H 13/04; A47H 13/16; A47H 15/00; A47H 15/04; A47H 19/00

USPC ..... 16/87.2, 87.8, 91, 93 D, 106

See application file for complete search history.

(56) References Cited

U.S. PATENT DOCUMENTS

| | | | | | |
|---|---|---|---|---|---|
| 635,295 | A * | 10/1899 | Brown | A47H 13/04 | 16/87.2 |
| 4,308,637 | A * | 1/1982 | Kucera | A47H 13/02 | 16/93 D |
| 5,367,742 | A * | 11/1994 | Bindman | A47H 13/02 | 16/87.2 |
| 5,787,954 | A * | 8/1998 | Herrera | A47K 3/38 | 16/87.2 |
| D459,201 | S | 6/2002 | Michaelson | | |
| 8,381,374 | B2 * | 2/2013 | Henry | A47K 3/38 | 160/330 |
| D680,421 | S | 4/2013 | Martin | | |
| 8,875,770 | B1 | 11/2014 | Martin | | |
| 2006/0042002 | A1 * | 3/2006 | Barrese | A47H 13/00 | 4/558 |
| 2007/0050904 | A1 | 3/2007 | Harwanko | | |

(Continued)

*Primary Examiner* — Roberta Delisle
(74) *Attorney, Agent, or Firm* — C. Nessler

(57) ABSTRACT

A hanger for a shower curtain comprises two opposing direction hooks and a captive roller for riding along the top of a curtain rod. A base part of the hanger has a hub with both a hook and a cradle at the lower end of a shank. The hook faces in one planar direction and a cradle faces in the opposite direction. The base comprises a spindle lying in said plane; the roller is rotatably captured on said spindle. The cap portion of a closure mounts on the free end of the spindle to keep the roller in place. The closure comprises a hook portion at the end of the shank; the hook portion mates with the cradle of the base. Preferably, the closure is rotatable about the spindle end, so that when the closure hook is disengaged from the cradle there is an opening which enables the hanger to be mounted and dismounted from a curtain rod.

22 Claims, 4 Drawing Sheets

(56) References Cited

U.S. PATENT DOCUMENTS

2007/0261330 A1* 11/2007 Liu ..... A47H 13/02
52/235
2007/0277355 A1* 12/2007 Richardson ..... A47H 13/01
24/716

* cited by examiner

MULTI-PIECE TWO-HOOK HANGER FOR A SHOWER CURTAIN

TECHNICAL FIELD

The present invention relates to hangers for shower curtains, in particular to hangers capable of simultaneously supporting a shower curtain and a spaced apart liner.

BACKGROUND

It is well known to suspend a shower curtain made of sheet material by engaging it with a multiplicity of hangers, also referred to as hooks, sometimes called rings, which wrap at least partly around a horizontal rod or bar running across the opening to a shower enclosure. The hangers are movable along the length of the rod, so the user can slide the curtain horizontally, for access to the enclosure and for bringing the edges of the curtain close to the sides of the enclosure to prevent water from splashing out of the enclosure. It is also well known to have a liner associated with a shower curtain. A liner is a sheet of material that is placed inboard of the primary shower curtain so that it hangs in parallel with the curtain. Often a liner is the water shedding part of the assembly and the curtain presents a decorative appearance. A liner may be removed and separately cleaned or replaced over time. Curtains and liners ordinarily have a series of spaced apart openings along their upper ends, so the openings can be engaged with the ends of a multiplicity of hangers positioned on a curtain rod.

A variety of hangers have been used in the prior art for suspending shower curtains, with and without liners. One kind of hook is called a double hook hanger. The hooks face in opposing directions; during use the hook facing into the shower enclosure carries the liner; the other carries the curtain. In better hangers, the loop of the hanger that rides on the curtain rod has several adjacent wheels that ride on the upper surface of the curtain rod. Harwanko U.S. Pat. Publication 2007/00509004 and Michaelson U.S. Pat. No. D459,201 show examples of double hooks having a plurality of wheels. The wheels are spaced apart along the arc of the loop. In a familiar hanger having the essential shape of a Harwanko hanger, there are two opposing-direction hooks at the end of a vertical shank that runs downwardly from a loop. There is an opening or mouth of the loop, so that the loop can be engaged with a curtain rod. However, having such an opening also means that if the hanger is canted or rotated about the length axis of the rod during use, and the opening moves toward the top of the curtain rod, the hanger may inconveniently come off the rod. Means for addressing that are of interest.

Hangers have been made of metal wire and plastic. Wire hangers have been commercially popular. They have intrinsic lightness of appearance and low material cost. But there can be corrosion problems, particularly where the rollers ride on the loop of the hanger. Generally, it is an aim to reduce the cost of making hangers and have hangers with long life.

SUMMARY

An object of the invention is to provide a hanger for a shower curtain, which hanger translates along the length of the curtain rod and is adapted to hold both a curtain and a liner. A still further object is to provide such a hanger which captures the curtain rod and is not susceptible to coming off the rod, when translated laterally. A further object is to make the foregoing hanger wholly of plastic or other corrosion resisting material, to make the hanger in economic fashion, and to have a hanger which is easily assembled with low labor cost.

In accord with the invention, an embodiment of hanger, for holding a shower curtain or liner and for mounting on a curtain rod and for linear motion along the length of the rod comprises a base having a hub from which projects both a spindle (in one direction, e.g., horizontally), and a shank in a second direction (e.g., downwardly). At the end of the shank of the base are a hook and a cradle that lie in the same plane and extend in opposite directions. A roller is mounted on the spindle and kept on the spindle by means of the cap of a closure. The closure comprises a shank that extends from the cap in a direction which is transverse to the spindle. There is a hook at the outer end of the closure shank; that hook has an outer convex curve surface which fits within the concave curve of the cradle. The closure of a preferred embodiment hanger is rotatable about the lengthwise axis of the spindle and the foregoing fit of hook and cradle is achieved when the hook is in the home position. When the shank of the closure is rotated away from the cradle, that creates an opening to the space within the interior of the hanger, so that the hanger can be placed on a rod; the closure is then rotated back to its home position. When the hook of the closure is positioned within the hole of a curtain or liner that restrains the hook from moving away from the cradle.

When the hook of the closure is in its home position, it may engage the cradle by being nested within a groove in the cradle. Alternatively, other fastening means may be used, including welding or adhesive when a user does not find the foregoing rotate-to-open feature necessary. In an alternative embodiment of hanger, there is no cradle and there is connector, such as a nub received in a resilient cavity, where the hooks align with each other.

The cap of the closure is kept on the spindle by alternative ways. In one embodiment a tab on the spindle engages the exterior of the cap of the closure. in another embodiment spindle has an end which is threaded and the closure has a threaded bore; in a variation the closure has a plain bore and there is a cap nut. In another embodiment there is a snap ring or E-ring on the end of the spindle.

A hanger of the present invention may be made of molded plastic, optionally of metal or a combination of metal and plastic. A hanger of the present invention is not prone to coming off a curtain rod if it is canted severely during use. Since the hanger can be made entirely of plastic, optionally of a lower cost non-corroding cast metal, it is resistant to corrosion and like degradation during use. The hanger of the present invention can be economically made by injection molding and can be assembled without tools or complex machinery.

DESCRIPTION

The present invention has technological relationship to commonly owned U.S. Pat. No. 8,875,770 of Martin et al., the disclosure of which is hereby incorporated by reference.

In the generality of the invention, a hanger has a straight spindle. A cylindrical roller having a pinched or concave central portion is mounted on a spindle which is part of a first piece called the base. Double hooks facing in opposing directions hang downwardly when the roller is mounted on a horizontal shower curtain rod. The first piece (base) is comprised a hook and a cradle shaped for receiving the hook of the second piece (the closure) which mounts on the spindle also. Preferably, the closure rotates to and from the plane of the double hooks and roller, to enable the hanger to be placed on an already installed shower curtain rod.

Figure 1:
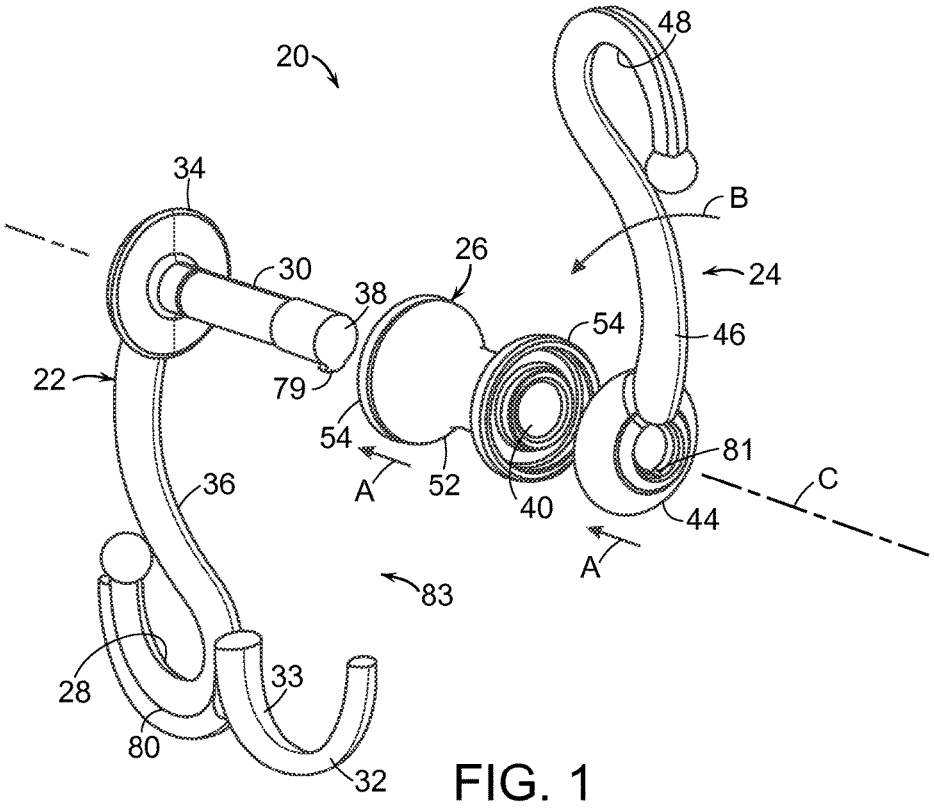
FIG. 1 is an exploded view of a three-piece hanger.
Figure 2:
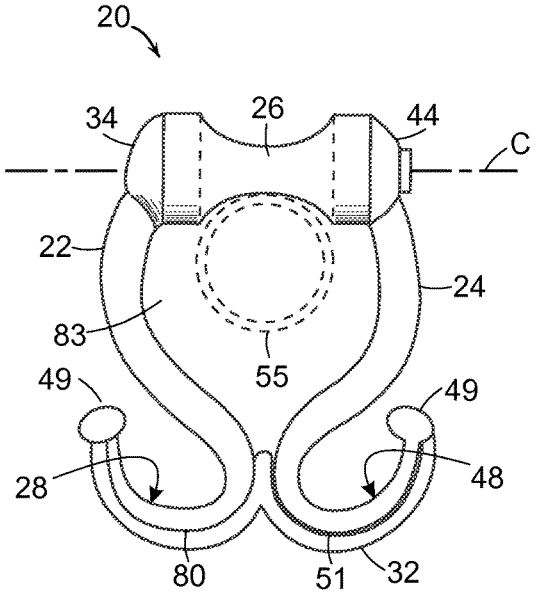
FIG. 2 is a front elevation view of an assembled hanger mounted on a curtain rod shown in phantom.

FIG. 1 is an exploded view of a hanger 20 which is shown in front view in FIG. 2. Hanger 20 is comprised of base 22, roller 26 which mounts on spindle 30 that is part of the base, and closure 24 which engages both spindle 30 and cradle 32 of the base 22 in the assembled article.

Figure 7:
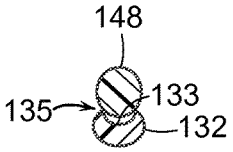
FIG. 7 is a cross section through the hook and cradle of the hanger of FIG. 5, showing how the hook is engaged with the channel of the cradle.

Base 22 comprises a hook 28 and cradle 32, both at the lower end of a shank 36 which runs downwardly from hub 34. Cradle 32 has a channel 33 for receiving the lower end of hook 48. Reference may be made to FIG. 7, discussed below. Spindle 30 extends laterally from the hub. The spindle and hook 28 lie in substantially the same plane. Closure 24 comprises a hook 48 which is at the end of a shank 46 that is connected to cap 44. Roller 26 has opposing end shoulders 54 and a curved central part 52, for riding on the top of a curtain rod. When assembled, roller 26 is captured between hub 34 and cap 44 of closure 24.

The exploded parts form an embodiment of assembled hanger 20 when they are moved as indicated by the arrows A and B in FIG. 1. As closure 24 is slipped lengthwise onto the shank 30, it is rotated as indicated by the arrow B in FIG. 1. As described below a tab 79 (shown in FIG. 1 and FIG. 4) keeps the cap 44 of closure 24 in place.

FIG. 2 is a vertical elevation view showing the assembled hanger 20 as it would mount on a curtain rod 55, shown in phantom. In this configuration, closure 24 is said to be in its home position, also called zero position. As also shown in FIG. 2, the cross section of curtain rod 55 is contained within a space 83 that is bounded by the two shanks 36, 46 and roller 26. If a curtain rod is dismountable from its mounting brackets, then a hanger 20 can be slipped onto the end of a rod 55. Thus, as described below, in some embodiments of the invention the closure can be mounted on and secured to the spindle end in a way such that it is not rotatable. Such a hanger will provide the advantages of simple construction and avoidance of the corrosion problems mentioned in the Background.

Figure 8:
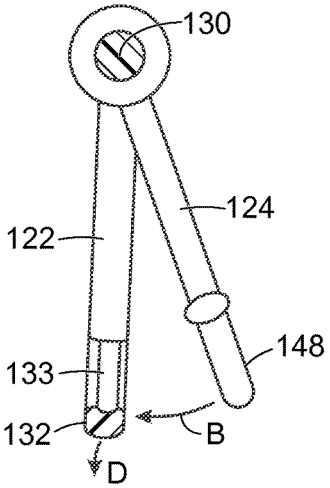
FIG. 8 is a partial cross section side view of the hanger of FIG. 5, showing how the hook of the closure engages the cradle.

It is probably more common that taking down a curtain rod to install hangers is an inconvenience. Thus, to accommodate a user in such situation, in preferred embodiment of the present invention a hanger may be "opened" by rotating the closure away from its home position. FIG. 1 and FIG. 8 are suggestive of how closure can be so-rotated. Closure 24, 124 is rotated out of the plane in which lie the spindle, the shank of the base part and the hook of the base part to make accessible, from the side of the hanger, the previously enclosed space 83.

After the hanger is placed on the rod, so that the spindle (with roller) lies atop the curtain rod and so the curtain rod is contained within the space 83, the closure is rotated downwardly to its home position. When the closure is in its home position, it will be appreciated that there is no orientation where the hanger can come off the rod by moving laterally relative to the rod. This is in contrast to prior art hangers where space 83 is not circumscribed by the structure of the hanger.

(A reference herein to elements of a hanger that lie together in a plane means that the central axes of such elements are nominally in the same plane. Since hangers are comprised of molded or machined parts having finite thicknesses, the term such as "lying in the same plane" and analogous or relative characterizations should not be construed strictly, but within the ordinary skill of the art.) With reference to FIG. 2, hanger 20 has a left hook 28 and an opposite-facing right hook 48, both for receiving either a shower curtain or a shower liner during preferred use. Each hook preferably terminates with a nub, like typical end nub 49, to provide a blunt user-friendly end. As can be seen in the various Figures, hooks 28, 48 have openings at the respective terminus ends 49. The openings which face generally upwardly, obliquely in the direction of lengthwise axis C, along which lies spindle 30. Since the hook-openings are defined by curved members the direction in which the openings face cannot be stated more definitely. Having hook-openings enables mounting on the hanger of a shower curtain or liner by one of a plurality of apart openings that are typically spaced apart along the length of the upper edge of the curtain or liner.

Figure 3:
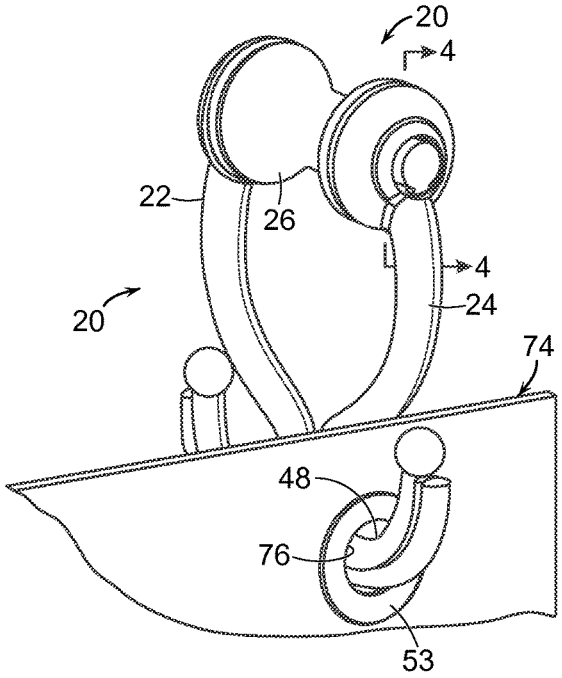
FIG. 3 is a perspective view of the hanger of FIG. 1 and FIG. 2 in combination with a portion of a curtain.

As will be appreciated from FIG. 2 and other drawings, the right hook 48 mates with cradle 32 of base 22. Preferably there is a small clearance or gap 51 between the cradle and hook. FIG. 3 is an isometric view showing hanger 20 in combination with a typical curtain 74 hanging from hook 48. A shower curtain will typically have a plastic or metal grommet 53 as reinforcement around the hole 76 through which passes hook 48 (or the hook of some other shower curtain hanger). The exterior dimensions of the combination of the mated hook 48 and cradle 32 are chosen such that, when the mated elements 48, 32 are passed through the typical size hole of about 0.38 inch (9.6 mm) diameter of a curtain or liner, they will have a close fit, and thus the elements 48, 32 will be kept in alignment. For example, the radial clearance might be about 0.07 inch (about 0.16 mm). In an alternative embodiment of hanger, cradle 32 and hook 48 may be kept in alignment by means of a tight fit or jam-fit between the elements 48, 32, and/or the engagement features described below for hanger 120 may be used.

Figure 2A:
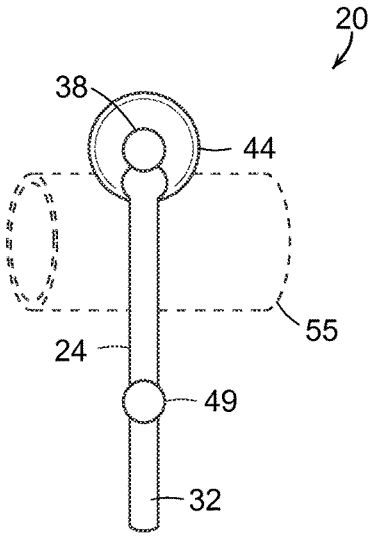
FIG. 2A is a side view of the hanger shown in FIG. 2.

FIG. 2 shows how hook 28 has a curved depression 80 that follows the line of the hook opening. The depression simulates in appearance the joint 51 between hook 48 and cradle 32. Thus hanger 20 desirably presents as symmetrical. FIG. 2A is a side elevation view of the hanger 20 shown in FIG. 1.

Figure 4:
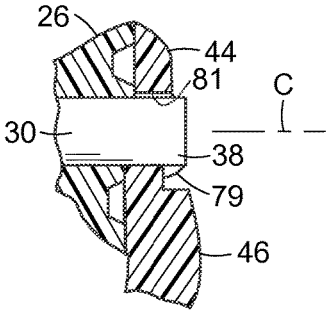
FIG. 4 is a cross section through a portion of the roller and closure of the hanger of FIG. 3, as they are mounted on the spindle.

Closure 24 is preferably retained on spindle 30 by means which includes tab 79 at the end 38 of the spindle. Tab 79 extends radially outwardly from spindle 30. The bore of closure 24 has a lengthwise slot 81 which enables the bore to slide onto spindle 30. After the closure is put in place and rotated downwardly as indicated by arrow B, tab 79 engages the outer end surface of cap 44 preventing it from coming off the end of the spindle. FIG. 4 is a partial cross section through the outer end 38 of spindle 30 showing cap 44 secured in place on the spindle. The bore 40 of roller 26 preferably also has a lengthwise slot (not shown) or a very loose fit, to facilitate sliding of the roller along the length of the spindle, in view of tab 79.

For simplicity of description, the orientation of the shank 46 or a tab 79 or a slot 81, can be considered with respect to the feature's orientation in the plane which is perpendicular to the length axis C of the spindle. When the feature is oriented as is the shank when hook 48 is aligned with the cradle, that orientation is called here the "zero position." (The zero position is also referred to as the home position above.) If as in the preferred embodiment of FIG. 1, the tab 79 is located at the zero position, then the slot 81 must be in a non-zero position to hold the cap on the spindle when the shank is in the zero position. The angle of orientation of the slot about the lengthwise axis C should differ from the angle of orientation of the tab by an amount which enables to tab to engage the surface of the cap fully. Thus, the difference is at least more than a few degrees, preferably about 10 degrees. However, as mentioned elsewhere here, a desirable way in which a hanger is engaged with a curtain rod is to rotate the closure away from the cradle to make accessible the space 83 within the confines of the hanger. Typically a closure will be rotated about 90 degrees for such purpose. Thus the difference in orientation between the tab and slot is preferably at least about 90 degrees or more, most preferably about 180 degrees, as shown in the preferred embodiment of FIG. 1 and FIG. 4.

The hanger base 22 and closure 24 are preferably made of ABS or polypropylene plastic; alternately a nylon fiber filled thermoplastic; alternately a thermoset plastic. Roller 26 may be made of comparable materials; preferably with a somewhat lower Durometer Number, for better frictional engagement with the surface of the shower rod.

Figure 5:
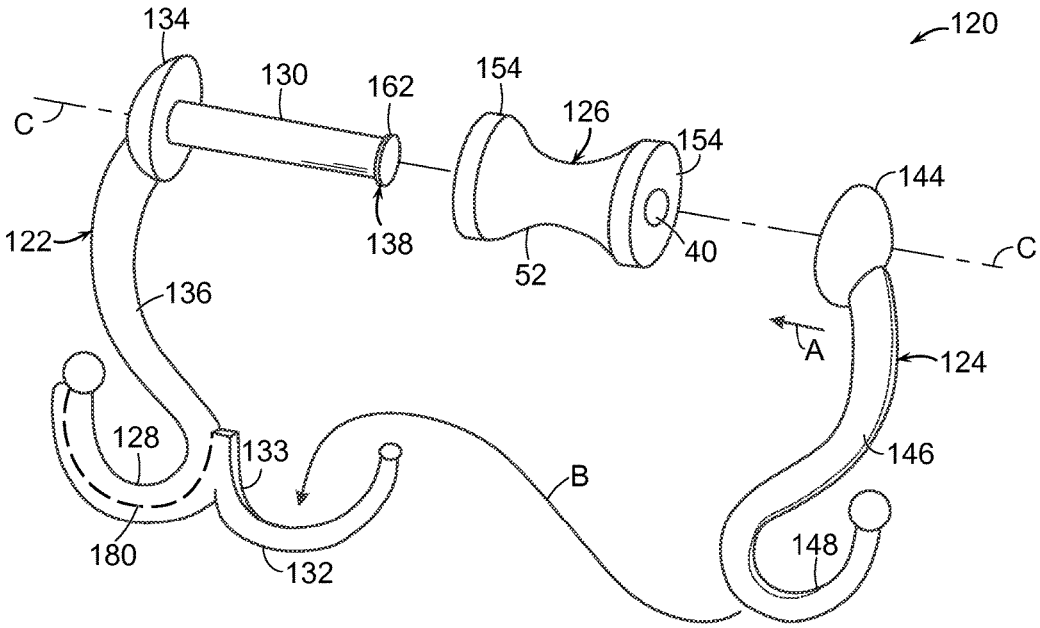
FIG. 5 is an exploded view of another embodiment of three-piece hanger.

FIG. 5 shows another embodiment of hanger, hanger 120, in exploded view. When assembled, hanger 120 looks substantially like the hanger 20 in FIG. 2. The parts of hanger 120 correspond with those of the hanger 20. In this and other embodiments, parts that are largely functionally the same have the same last two digits, namely, hook 128, hub 134, shank 146, shoulders 154, and depression 180.

Hanger 120 is comprised of a base 122, a roller 126 which mounts on the spindle 130 that is part of the base, and a closure 124 which engages the end 138 of the spindle. The parts engage as an assembly when moved as indicated by the arrows A and B, consistent with the description above that attends hanger 20. Hook 148 mates with the cradle 132 of the base part, in the assembled article. Cap 144 of closure 124 engages the end 138 of the spindle. An integral circumscribing ridge 162 at the end 38 of the spindle elastically deforms the bore 158 and of the cap 144 of closure 124. Thus cap 144 of closure 124 becomes locked onto the spindle, as illustrated by the partial cross section of FIG. 6.

As shown in FIG. 5, cradle 132 projects laterally from the lower end of base 122. In one embodiment, the fit of the hook 148 with the cradle 132 may be the same as described above for hanger 20. Alternatively, illustrated by the cross section of FIG. 7 and the side view of FIG. 8, there may be a snap-fit joint 135 between the two elements; hook 148 snap-fits into channel 133 that runs along the inner curve of cradle 132. As shown in FIG. 8, as cap 124 is rotated about spindle 130 following the path indicated by arrow B, cradle 132 deflects downwardly as indicated by arrow D. Then the cradle springs upwardly to engage the bottom of hook 138 and inhibit further rotation.

In the generality of the invention, an embodiment of hanger does not need to be opened for engagement with a curtain rod (such as when it can be slid on the end of the rod). In such instance the parts 148 and 132 may be secured to each other, such as by an adhesive or fusion weld or mechanical fasteners, such as banding, screws, rivets, pinning and so forth, not shown. When the hook 148 and cradle 132 are to be permanently secured to each other, then the engagement of the closure 124 with the spindle end 138 need not be such as to permit much if any rotation. For example, a square cross section spindle end may be engaged with a square bore cap or in another way which permits insubstantial relative rotation. In such instance the hook 148 of the closure may be engaged with the cradle 132 of the base by elastically deflecting the plastic shank of the closure and then letting it go, to spring into place on the cradle.

Figure 6:
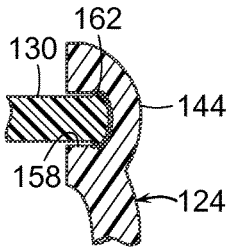
FIG. 6 is a detail view of the cap of a closure as it is engaged with the end of a spindle.
Figure 9:
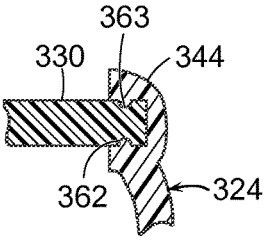
FIG. 9 is a partial cross section front view an embodiment of cap engaged with the end of a spindle.

FIG. 9 is a partial cross section view like FIG. 6 and FIG. 4. FIG. 9 shows an alternative configuration closure 324 which comprises a cap 344 having an internal feature 363 such as a molded in ridge, captive snap ring, or the like, that engages a circumferential groove 362 at the free end of spindle 330. The cap and spindle become engaged when the cap is pushed on with sufficient force, so the bore of cap 34 springs outwardly, then inwardly to lock the cap to the spindle. Alternatively, cap may have an internal groove and the snap ring or ridge may be placed on the exterior of the spindle end.

Figure 10:
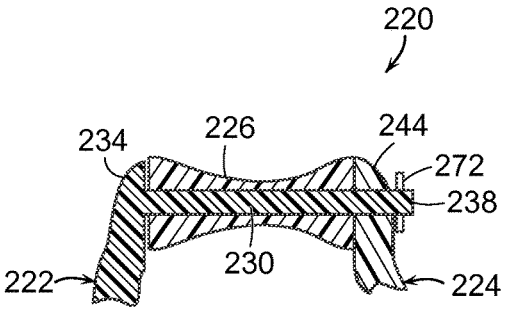
FIG. 10 is a partial cross section front view of the upper portion of a hanger showing how a roller and cap are retained on the end of a spindle that projects through a hole in the cap of the closure.

FIG. 10 is a vertical elevation lengthwise cross section through the upper portion of alternative embodiment hanger 220. Spindle 230 which extends from base 222 at the location of hub 234 carries roller 226. The roller is held in place by the cap 244 of closure 224. Cap 244 is kept on the end of spindle 230 by stainless steel E-ring 272 that engages a circumferential groove at the end 238 of the spindle.

Figure 11:
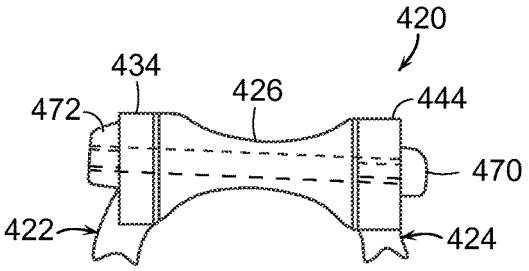
FIG. 11 is a front view of the upper portion of a hanger showing a base and closure, with a spindle that is a separate element which passes through holes in each of the cap of the closure and hub of the base.

FIG. 11 is a vertical elevation view of the upper portion of alternative embodiment hanger 420. Roller 426 is captured between hub 434 and cap 444 which are respectively at the upper ends of base 422 and closure 424. Bolt 470 runs through a hole in cap 444, through the bore of the roller 426, and through a hole in hub 434. Nut 472 is on the threaded end of bolt 470. Alternatively, bolt 470 can be a shoulder bolt which is screwed into a threaded hole in head 434.

Figure 13:
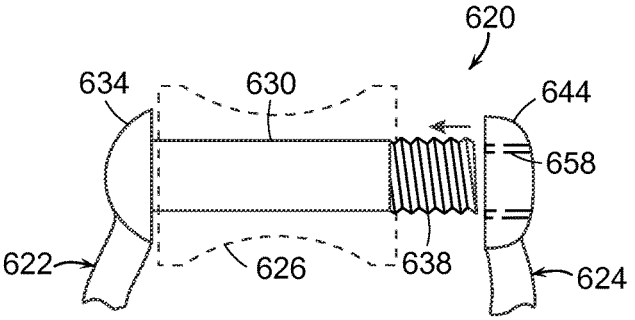
FIG. 13 is an exploded view of the upper part of a hanger where the cap of the closure engages with the spindle by means of a threaded bore.

FIG. 13 is a vertical elevation view of part of the upper portion of alternative embodiment hanger 620. The roller 626 is shown in phantom. Spindle 630 extends from the hub 634 of base 622 and has an end 638 which is threaded. The cap 644 of closure 624 has a threaded bore 658; and the cap screws onto the spindle to capture the roller on the spindle.

Figure 14:
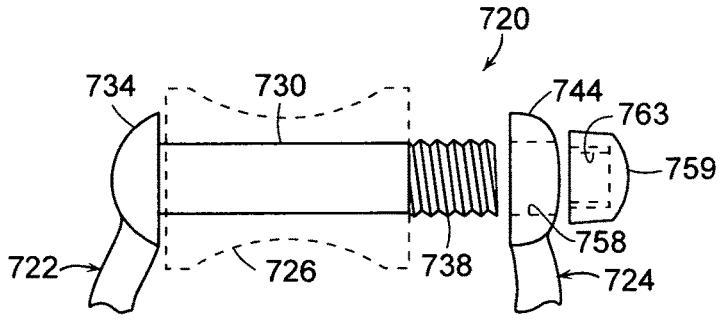
FIG. 14 is an exploded view like FIG. 13, showing how the cap of a closure is held on the spindle by a cap nut.

FIG. 14 is a vertical elevation view of part of the upper portion of alternative embodiment hanger 720. The roller 726 is shown in phantom. Spindle 730 extends from the hub 734 of base 722 and has an end 738 which is threaded. The cap 744 of closure 724 has a threaded plain bore 758 and slips onto the spindle end 738. A cap nut 759 has a threaded bore 763 and screws onto the spindle end 738, to capture both the closure 724 and the roller 726 on the spindle.

Figure 15:
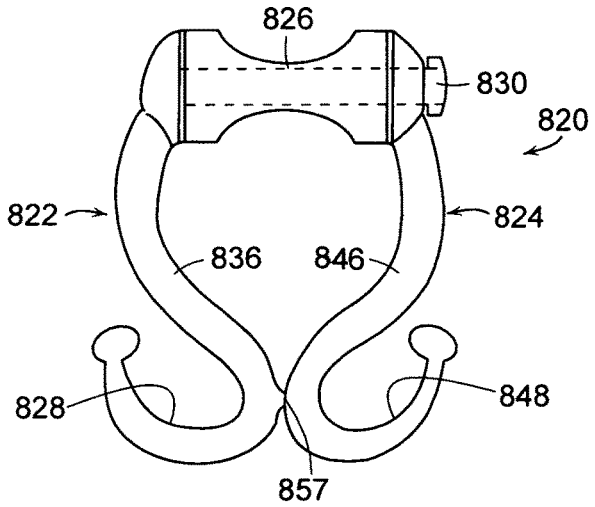
FIG. 15 is a front elevation view of an alternate embodiment hanger.

FIG. 15 is a front elevation view of an alternate embodiment hanger 820 which generally has a configuration like those described previously, but the connection between the hook of the base and the hook of the closure is different. Hanger 820 comprises base 822, roller 826 which is mounted on the spindle that extends from the base, and closure 824 which is secured to the end of spindle 830. The spindle details and the engagement of the closure with the end of the spindle may be any of those which have been described above. Base 822 has a shank 836 from the bottom of which laterally extends hook 828. Closure 824 has a shank 846 from the bottom of which extends hook 848. The inner portions of each of the hooks are connected to each other by connector 857.

Figure 16:
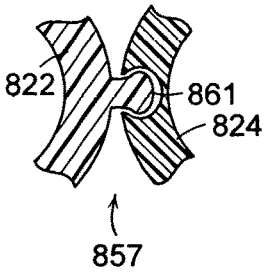
FIG. 16 is a partial cross section detail of the hanger of FIG. 15 showing the connector.
Figure 17:
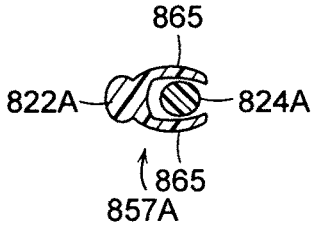
FIG. 17 is view like FIG. 16 showing an alternative embodiment connector.

FIG. 16 is a partial cross section detail of the hanger of FIG. 15 at the location of connector 857, showing how nub 861 that extends from the side of the hook of base 822 is captured within a resilient pocket of the closure 824 when the closure is in its home position. To provide access to the interior space of the hanger so the hanger may be placed on a curtain rod, a user may pull the hooks apart, drawing the nub from the pocket. The closure 824 then may be rotated back to its home position and the nub pressed back into the pocket. FIG. 17 is a view like FIG. 17, showing an alternative embodiment connector 857A. Base 822A has resilient tabs 865 which grasp in cradle like fashion the outside surfaces of closure 824A. In alternative embodiments of the invention, the connector features may be interchanged with respect to which one is on the base and which one is on the closure.

The invention has an advantage over prior art hangers. Compared to multiple wheels, a roller provides different load bearing force distribution on the top of a curtain rod. The difficulties which attend the use of wheels are avoided, e.g. getting them in place and keeping them in place at the top of the loop. Hangers of the present invention can be wholly made of plastic and thus corrosion problems are avoided.

Figure 12:
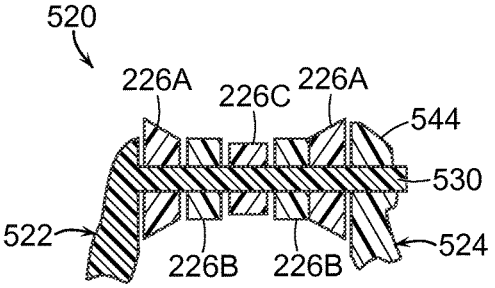
FIG. 12 is a cross section of the upper end of an alternate embodiment hanger having multiple wheels.

Notwithstanding the foregoing advantage of the single piece roller, the foregoing spindle and closure attachment features and other features described above may alternatively be used in combination with a roller which is comprised of multiple segments, i.e., a roller which is in the form a plurality of abutting wheels. FIG. 12 is a cross section through the upper end of hanger 520 which has a base 522, spindle 530, cap 544, and closure 524 that are like those of hanger 20. The roller is comprised of segments (wheels) 226A, 226B, 226C and 226D which have different diameters, so as to present a concavity that rides on a curtain rod.

It will be appreciated that the sturdy shape of the components of the hanger of the present invention, compared to prior art hangers which comprise metal wires or metal wheels, enables hangers of the present invention to be made by injection molding of plastic, and thus past corrosion problems are avoided. Alternatively, the hanger may be made in part or whole of cast zinc, aluminum, stainless steel, or brass. A combination of plastics and metals may be used.

The ornamental design of the shower curtain/liner hanger of shown in the drawings is novel. In particular, reference is made to the appearance, configuration, and ornamental design of shower curtain/liner hanger 20 in FIGS. 2, 2A and 4, and the variations on such hanger, as are portrayed in the other Figures herein.

The invention, with explicit and implicit variations and advantages, has been described and illustrated with respect to several embodiments. Those embodiments should be considered illustrative and not restrictive. Any uses of words which relate to the orientation of an article pictured in space are for facilitating comprehension and should not be limiting should an article be oriented differently. Any use of words such as "preferred" and variations thereof suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A hanger, configured for movement along a length of a shower curtain rod while holding the upper end of one or both of a shower curtain and a shower liner, which comprises:

(a) a base comprising
- a hub;
- a spindle, lying along a lengthwise axis, extending from the hub to a spindle free end, the spindle having an engagement feature at said free end;
- a shank integral with the hub and extending transversely to the spindle from the hub to a shank end;
- a hook integrally connected to the shank end, the hook lying in a plane with said spindle, the hook having an opening which faces generally in the direction of said lengthwise axis;
- a cradle, integrally attached to shank end, lying in said plane, the cradle comprising a concave curve surface portion which faces generally in the direction of said lengthwise axis;

(b) a closure engaged with the base, comprising
- a cap having an engagement feature that is mated with said spindle engagement feature;
- a shank integral with the cap, extending from the cap to a shank end;
- a hook integral with the shank end, the hook having an opening which faces generally in part in the direction of said lengthwise axis, the hook comprising a convex exterior curve surface portion shaped to mate with the concave curve surface portion of the cradle of the base; and, (c) a roller having a concave exterior, rotatably mounted on the spindle intermediate the hub and the cap, for rolling lengthwise along said shower curtain rod;

wherein the arrangement of said shank of the base, said shank of the cap and said roller define a space shaped for receiving a transverse section of said curtain rod when the hanger is mounted on said curtain rod for use.

2. The hanger of claim 1 wherein the cradle is fastened to the hook of the closure by one or more of a connector, a fusion weld, an adhesive, or at least one fastener.

3. The hanger of claim 1 wherein the closure is rotatable about the spindle lengthwise axis at the location where the cap of the closure is engaged with the free end of the spindle; wherein the closure rotates from a home position in which the hook of the closure substantially lies in said plane of the spindle and hook of the base, to a non-home position at which an access opening to said space is created.

4. The hanger of claim 3 wherein the cradle concave surface portion comprises a channel for receiving the convex exterior curve surface portion of the hook of the closure, wherein the cradle concave surface portion sets within said channel when the closure is in a home position, and wherein the cradle concave surface portion is displaced from said channel when the closure is in a non-home position, which a non-home position provides an opening for access to said space, to enable mounting of the hanger on the shower curtain rod.

5. The hanger of claim 4 wherein the engagement feature of the spindle comprises a tab at the end of the spindle, the tab extending transverse to the lengthwise axis of the spindle; and wherein the engagement feature of the cap comprises a bore having a lengthwise slot, shaped for passage therealong of said tab when the cap is rotated about the spindle end to align the tab with the slot.

6. The hanger of claim 5 wherein said lengthwise slot in the bore of the cap is circumferentially offset from the tab at the end of the spindle by 90 degrees or more.

7. The hanger of claim 4 wherein the cap engagement feature comprises a threaded through hole, and wherein the spindle engagement feature comprises a threaded portion of the spindle free end.

8. The hanger of claim 3 in combination with a shower curtain or a shower liner, wherein said curtain or liner has an upper edge with a plurality of spaced apart holes, wherein said hook of the closure and said cradle of the base are mated with each other and positioned together within one of said holes.

9. A method of engaging a hanger of claim 3 with a curtain rod and hanging one or more of a shower curtain and a shower liner from the curtain rod, which comprises:

(a) rotating the closure about lengthwise axis of the spindle so the shank of the closure lies in a second plane which is at an angle to said plane of spindle and shank of the base, thereby to provide an access opening to said space;

(b) putting the hanger on the shower curtain rod by passing the curtain rod through said access opening, so that the roller rests on the curtain rod for rolling lengthwise along the curtain rod; and (c) rotating the closure so that the closure lies in said plane of the spindle and shank of the base, and so that said convex exterior curve surface portion of the hook of the cap is mated with the concave curve surface portion of the cradle, whereby said shower curtain rod is contained within said space.

10. The method of claim 9 further comprising:

(d) engaging a shower curtain or a liner having a plurality of holes with the hanger when the closure and cradle of the base are in the mated condition achieved in step (c) by positioning the hook of the closure and the cradle of the base within one of said holes, to thereby inhibit subsequent substantial rotation of the closure about said lengthwise axis of the spindle and resultant separation of the cradle and the hook of the cap.

11. A method of engaging a hanger of claim 3 with a curtain rod and mounting one or more of a shower curtain and a shower liner, which comprises:

(a) rotating the closure about lengthwise axis of the spindle so the shank of the closure lies in a non-home position characterized by a second plane which is at an angle to said plane of spindle and hook of the base, thereby to provide an access opening to said space;

(b) putting the hanger on the shower curtain rod by moving the curtain rod through said access opening, so that the roller rests on the curtain rod for rolling lengthwise along the curtain rod; and (c) rotating the closure back to the home position, whereby said shower curtain rod is contained within said space.

12. The method of claim 11 further comprising:

(d) engaging a shower curtain or a liner having a plurality of holes with the hanger when the closure and cradle of the base are in the mated condition achieved in step (c) by positioning the hook of the closure and the cradle of the base within one of said holes, to thereby inhibit subsequent substantial rotation of the closure about said lengthwise axis of the spindle relative to the hook of the base.

13. The hanger of claim 1 wherein the engagement feature of the cap comprises a blind hole having an internal ridge or internal groove; and wherein the engagement feature of the spindle comprises an external groove or an external ridge.

14. The hanger of claim 1 wherein the cap engagement feature comprises a threaded through hole, and wherein the spindle engagement feature comprises a threaded portion of the spindle free end.

15. The hanger of claim 1 wherein the engagement feature of the cap comprises a through hole; wherein the engagement feature of the spindle comprises a spindle free end having a retainer; wherein the spindle free end is positioned within the through hole of the cap and the retainer prevents the cap from moving lengthwise off the free end; and wherein the spindle is either integral with the hub or is a pin or bolt that passes through a hole in the hub.

16. The hanger of claim 1 wherein the spindle is threadingly engaged with the hub.

17. The hanger of claim 1 wherein the roller is comprised of a multiplicity of wheel-like segments.

18. A hanger, configured for movement along a length of a shower curtain rod while holding the upper end of one or both of a shower curtain and a shower liner, which comprises:

(a) a base comprising a hub;

a spindle, lying along a lengthwise axis, extending from the hub to a spindle free end, the spindle having an engagement feature at said free end;

a shank integral with the hub and extending transversely to the spindle from the hub to a shank end;

a hook integrally connected to the shank end, the hook lying in a plane with said spindle, the hook having an opening which faces generally in the direction of said lengthwise axis;

a cradle, integrally attached to shank end, lying in said plane, the cradle comprising a concave curve surface portion which faces generally in the direction of said lengthwise axis, the cradle comprising a channel for receiving a convex exterior curve surface portion of a hook of a closure;

(b) a closure secured to the base, comprising a cap having an engagement feature that is mated with said spindle engagement feature;

a shank integral with the cap, extending from the cap to a shank end;

a hook integral with the shank end, the hook having an opening which faces generally in part in the direction of said lengthwise axis, the hook comprising a convex exterior curve surface portion shaped to mate with the concave curve surface portion of the cradle; and, (c) a roller having a concave exterior, rotatably mounted on the spindle intermediate the hub and the cap, for rolling lengthwise along said shower curtain rod;

wherein said shank of the base and said shank of the cap and said roller are arranged to define a space shaped for receiving said curtain rod when the hanger is mounted on the shower curtain rod for use;

wherein the closure is rotatable about the spindle lengthwise axis at the location of the cap at the free end of the spindle; and, wherein the hook convex exterior surface portion sets within said channel of the cradle when the closure is in a first rotational position which is the home position; and wherein the hook convex exterior surface portion is displaced from said channel when the closure is in a second rotational position that is displaced from the home position, to said second rotational position providing an access opening to said space for passage of a curtain rod, to enable mounting of the hanger on the shower curtain rod.

19. A molded plastic hanger configured for movement along a length of a shower curtain rod while supporting the upper end of one or both a hanging shower curtain and a hanging liner, which comprises:

(a) a base comprising a hub;

a spindle, lying along a lengthwise axis, extending from the hub to a spindle free end, the spindle having an engagement feature at said free end;

a shank integral with the hub and extending transversely to the spindle from the hub to a shank end;

a hook integrally connected to the shank end, the hook lying in a plane with said spindle, the hook having an opening which faces generally in the direction of said lengthwise axis;

a cradle, integrally attached to shank end, lying in said plane, the cradle comprising a concave curve surface portion which faces generally in the direction of said lengthwise axis;

(b) a closure secured to the base, comprising a cap mounted on the spindle free end;

a shank integral with the cap, extending from the cap to a shank end;

a hook integral with the shank end, the hook having an opening which faces generally in part in the direction of said lengthwise axis, the hook comprising a convex exterior curve surface portion shaped to mate with the concave curve surface portion of the cradle; and, (c) a roller having a concave exterior, rotatably mounted on the spindle intermediate the hub and the cap, for rolling lengthwise along said shower curtain rod;

wherein said shank of the base and said shank of the cap and said roller are arranged to define a space shaped for receiving a cross section of said curtain rod when the hanger is mounted on the shower curtain rod for use;

a connector running between the hook or the base and the hook of the closure, to attach each hook to the other.

20. The hanger of claim 19 wherein the connector is releasable and wherein the closure is rotatable at the free end of the spindle about the spindle lengthwise axis.

21. The hanger of claim 19 wherein the base and closure are made of molded plastic, and wherein said connector comprises resilient plastic features which are disengageable from each other.

22. The hanger of claim 19 wherein the connector comprises a cradle shaped feature on one hook which engages a portion of the other hook.

* * * * *